United States Patent [19]

Varga

[11] 4,098,063

[45] Jul. 4, 1978

[54] HIGH SPEED FLY-OFF STRANDER

[75] Inventor: Joseph A. Varga, Toronto, Canada

[73] Assignee: Ceeco Machinery Manufacturing Limited, Concord, Canada

[21] Appl. No.: 792,980

[22] Filed: May 2, 1977

[51] Int. Cl.[2] ..... D07B 3/04; D07B 3/06

[52] U.S. Cl. ..... 57/13; 57/6; 57/15

[58] Field of Search ..... 57/9, 13, 15, 34 R, 57/6, 58.36, 58.72, 58.83

[56] References Cited

U.S. PATENT DOCUMENTS

| | | | |
|---|---|---|---|
| 824,171 | 6/1906 | Champlin | 57/13 X |
| 1,024,196 | 4/1912 | Miller | 57/13 |
| 3,234,721 | 2/1966 | Carter | 57/13 |
| 3,448,569 | 6/1969 | Brown et al. | 57/15 |

FOREIGN PATENT DOCUMENTS

| | | | |
|---|---|---|---|
| 858,270 | 12/1970 | Canada | 57/13 |

*Primary Examiner*—Donald Watkins
*Attorney, Agent, or Firm*—Lackenbach, Lilling & Siegel

[57] ABSTRACT

A high speed rigid-type strander includes a main shaft or body mounted for rotation about its longitudinal axis with the core wire advanced through the strander substantially along its axis of rotation. Bobbin supporting members are fixedly mounted externally on the shaft or body for rotation therewith and for mounting the bobbins in positions displaced from the axis of rotation. The bobbins are mounted with their longitudinal axes oriented at substantial angles from the axis of rotation of the shaft or body, and preferably at an angle substantially normal thereto. The bobbins can be mounted to either fly-off the wire in a generally radially outward direction or in a generally radially inward direction with the bobbins stationary about their longitudinal axes. A strander of the above general type is also described which can be used in either a fly-off mode of operation or in a traditional pay-off mode wherein the bobbins rotate about their own axes.

38 Claims, 8 Drawing Figures

10
12
14
16
18
20
22
24
26
34
34a
36
38
40
42
44

HIGH SPEED FLY-OFF STRANDER

BACKGROUND OF THE INVENTION

The present invention generally relates to high speed cable or wire stranders, and more specifically to a high speed rigid-type strander in which the axes of the bobbins are oriented at substantial angles from the axis of rotation of the hollow body or main shaft to which the bobbin supporting members are rigidly connected.

When manufacturing a cable from a plurality of wires, a core wire formed by either a single wire or a plurality of already stranded wires is usually passed through the machine and other wires are wrapped around the core wire either while the core wires move along its path or at the end of the machine. This function is usually carried out by high speed machines which, as a rule, include one or more rotatable frames or housings and a plurality of wire-carrying bobbins located within the frame or carried by supports mounted on the frames.

The core wire is usually paid-off from a bobbin mounted outside the frame and passed through the frame through a path either along the axis of rotation of the frame or displaced from the axis of rotation of the frame. The way the core wire is handled characterizes the type of wire strander and its application.

If the core wire is passed through the machine along its axis of rotation, the wire carrying bobbins rotate around it and the wires paid-off are wound on the core wire at several points along the machine. This system allows the manufacture of conductors with a high number of wires and a change in direction of the various layers since the machine is composed of many sections independent of each other. Furthermore, since the core wire passes substantially along the axis of the machine, a large multi-stranded core can be used.

If the core wire is passed through the machine along a path significantly displaced from the axis of rotation of the frame, the wire carrying bobbins are positioned inside the frame along its axis of rotation and they remain stationary while the frame rotates. The cable wires are paid-off from the bobbins and the wires pass through a path displaced from the axis of rotation of the machine and are wound around the core wire at the end of the machine. This method allows the manufacture of conductors with a relatively low number of wires and the various layers of the stranded conductors must be wound in the same direction.

In the manufacturing of stranded cable from a plurality of wires, three basic types of stranders are presently used in the industry. In one type, the tubular strander, the bobbins are placed in cradles which are mounted on bearings in a tubular rotatable frame or housing. During the operation, the frame rotates while the cradles and the bobbins are stationary. The wires are paid-out or pulled from the bobbins and are brought along the frame through guides until they are wound on the core wire which is usually taken from a bobbin mounted outside the frame and passed through the frame along a path that is parallel to the axis of the machine, but significantly displaced from the center as are the other wires paid-out from the bobbins loaded on the cradles inside the tubular frame. Such a strander is shown and described in the products catalog published by Ceeco Machinery Manufacturing Limited of Concord, Ontario, Canada.

The second basic type of strander is known as a rigid strander. In this type of strander, the bobbins are usually mounted on a rigid rotatable frame and they are solidly connected to the frame itself, this machine is usually made in sections and follows the classic stranding formations of conductors made with wires of the same diameters. In the basic formation, each layer above the core wire has six more wires than the previous one. Thus, the first layer directly on the core wire has six wires, the second wire layer has twelve wires, the fourth wire layer has eighteen wires, the fifth wire layer has twenty-four wires, etc. While rigid stranders are generally slower than tubular stranders, they are more compact and are normally used to manufacture conductors of nineteen or more wires, especially in the non-ferrous industry. For conductors with a lower number of wires, tubular stranders are adopted as a rule, in view of their higher speeds. Rigid stranders are also shown and described in the above-identified Ceeco Machinery Manufacturing Limited catalog.

The third type of strander commonly used is called a planetary strander and, in many respects, is similar to the rigid strander. However, in the planetary strander the bobbins are mounted on cradles which are kept in a fixed plane through mechanical means while the machine rotates. The object of such stranding operation is to avoid any twisting of the wire during the stranding operation as is done when using a rigid frame strander. Planetary stranders are also shown and described in the above Ceeco catalog. Tubular stranders and planetary stranders do not twist the base wire during the operation and, therefore, can be used both in the ferrous and non-ferrous industries. Rigid frame stranders are used as a rule only when the base wire can be subject to twisting.

In the past, wire carrying bobbins mounted on the frame of the strander have usually been mounted so that the bobbins were required to rotate along their longitudinal axis in order to pay-off the wire. This arrangement usually requires some control of the rotation of the bobbins, such as a brake mechanism for each bobbin to provide the required wire tension and to assure that the bobbins will not continue to rotate when the frame of the strander has stopped its rotation.

The braking device causes the tension of the wire paid-off from the bobbins to vary during the operation of the strander since the wire pulling tension required to make the bobbin rotate is different when the bobbin is full or near empty. If the initial braking force is adjusted for a full bobbin, the same braking force applied to a bobbin with partially depleted wire supply is sometimes sufficient to cause unacceptable stretch, especially for wires of the smaller gauge. In such a case, the cable produced will be malformed. Also, since the braking force is applied to each bobbin before the initial start of the strander, there is a tendency to stretch the wire before the strander reaches its normal operational speed. Because of frequent malfunction of the brakes, the wires from the bobbins within the frame of the strander occasionally continue to pay-out after the strander has been stopped, and because different brake forces are applied to different bobbins, different tensions are created in the wire paid-out from the bobbins. Therefore, many times the cable formed by traditional stranders have one or more wires loosely wrapped with the remaining wire more tightly wrapped.

One attempt to overcome some of the above-mentioned problems was to fly-off the wires from stationary bobbins since this provided a better means of controlling the tension irrespective of the amount of wire remaining on the bobbin. A fly-off system introduced for stranders having a core wire path significantly displaced from the axis of rotation of the machine and the wire carrying bobbins positioned within the tubular frame with longitudinal axes both parallel and perpendicular to the axis of rotation of the frame. For example, in U.S. Pat. No. 3,827,225, for "High Speed Strander", both a tubular and a rigid strander are disclosed wherein the wires fly off bobbins which are mounted on shafts parallel to the axis of the machine rotating frame. With respect to the tubular strander disclosed in the above patent, the bobbins are positioned along the axis of rotation of the tubular, cylindrical frame and, therefore, the core wire cannot pass through the axis of rotation, but is displaced therefrom as in conventional tubular stranders. This presents a disadvantage inasmuch as it limits the size of the core wire which may be used. With respect to the rigid strander disclosed in the above patent, wherein the core wire passes along the axis of rotation of the frame and where the bobbins are mounted on the frame with their longitudinal axes approximately parallel to the axis of the machine, the rigid strander disclosed has several disadvantages because, while the wire flies off during rotation of the frame, it is subject to significant variations in centrifugal forces which tend to push the wire outwardly, thus creating oscillations of the wire tension. This is particularly severe when using large bobbins as is the case in the industry, since such tension variations may result in fluctuations in tightness of the finished stranded product. Another disadvantage of the rigid-type strander disclosed in the above patent is that the bobbins must be mounted on cantilevered shafts parallel to the axis of rotation, thus limiting the size of bobbins that can be used or causing a severe reduction in the speed of the machine since large bobbins and high speeds would subject the cantilevered shaft to excessive stresses. The disclosed configuration also requires that the bobbins be positioned far from the axis of rotation, thus increasing the centrifugal forces that come into play. In order to maintain the same total number of bobbins while decreasing the radial distances at which the shafts are mounted from the axis of rotation, the overall length of the machine may have to be increased to an undesirable or impractical length.

Another fly-off, tubular-type strander is disclosed in U.S. Pat. No. 3,902,307 for "Modified High Speed Strander". This patent discloses a tubular-type strander which includes a hollow cylindrical housing or tube inside which a plurality of bobbins are supported along the axis of rotation of the cylindrical housing. With this strander, the bobbins are situated on the axis of rotation to avoid significant centrifugal forces thereon. Consequently, as with stranded tubular stranders, the core wire cannot go through the center or axis of rotation of the frame or housing, but must be bent or deflected at least four times as the core wire is guided along the axis, and thence along the housing wall, and finally moved towards the housing axis. Such displacement of the core wire from the axis of rotation, as suggested above, limits the size of the core wire which can be used and, therefore, limits the size of the overall product which can be handled or produced by the strander.

In the tubular-type strander disclosed in both of the above-identified patents, the bobbin supporting stems or shafts are pivotally connected to the cylindrical housings by means of pivot arrangements to permit the bobbins to be loaded and removed through relatively small openings in the tubular or cylindrical housings. Such constructions have made these stranders more complicated, and more inconvenient to use.

SUMMARY OF THE INVENTION

Accordingly, it is an object of the present invention to provide a high-speed strander which does not exhibit the above mentioned disadvantages inherent in presently known and used stranders.

It is another object of the present invention to provide a high-speed rigid strander which is simple in construction and economical to manufacture.

It is still another object of the present invention to provide a rigid-type strander wherein the bobbins are oriented with their longitudinal axes at substantial angles from the axis of rotation of the shaft or body on which the bobbins are mounted.

It is yet another object of the present invention to provide a high-speed rigid-type strander wherein the bobbins are mounted externally of a rotating shaft, to permit a core wire to be advanced substantially along the axis of rotation through the shaft, if it is hollow, or along its external surface, if the shaft is solid.

It is a further object of the present invention to provide a rigid-type strander wherein the bobbins are mounted with their longitudinal axes oriented at substantial angles from the axis of rotation of the body or frame on which the bobbins are mounted, the bobbins being displaced from the axis of rotation.

It is still a further object of the present invention to provide a high-speed, rigid-type fly-off strander which eliminates the bending stresses by centrifugal forces on cantilevered supporting shafts on which the bobbins are mounted, so as not to limit the maximum speed of rotation of the bobbins due to possible damage to the supporting shafts.

It is yet a further object of the present invention to provide a high-speed, rigid-type fly-off strander which can be used to fly off both fine as well as heavy gauge wires, and which can be used in conjunction with both small and large bobbins.

It is an additional object of the present invention to provide a rigid strander of the fly-off type which significantly increases the maximum speed of operation as compared with presently used standard rigid stranders.

It is still an additional object of the present invention to provide a high-speed strander for forming a cable with a large number of wires, and if necessary, with reverse lay construction for each layer of wires.

It is also an object of the present invention to provide a strander in which the bobbins are placed on supports attached to the main shaft in such a way that their axes are approximately perpendicular to the axis of rotation of the frame, thus minimizing variations of centrifugal forces acting on the wires during the fly off and, therefore, minimizing variations of tension in such wires.

It is also another object of the present invention to provide a high-speed strander with the core wire passing through the machine substantially along its axis of rotation, and where the center of gravity of the bobbins is as close as possible to the axis of rotation, this allowing significant increases in speed as compared to other types of stranders using the same bobbin diameters.

It is also a further object of the present invention to provide a high-speed strander where the shafts supporting the bobbins or other bobbin supporting members are only subject to minimal stresses due to centrifugal forces, and, therefore, allow a simple and reliable construction besides having great advantages as far as loading and unloading is concerned.

In order to achieve the above objects, as well as others which will become apparent hereafter, a strander in accordance with the present invention comprises at least one elongated main shaft mounted for rotation about its own axis and adapted to advance a core wire proximate to the axis of rotation of the strander. Support means are provided for securing a plurality of wire carrying bobbins externally of said main shaft in positions displaced from the axis of rotation of said main shaft and with the longitudinal axes of said bobbins oriented at a substantial angle from the axis of rotation of said main shaft. Pay-out means are provided for guiding wire off a respective bobbin, and thence in a direction generally parallel to the axis of rotation of the strander thus enabling the wires which are paid off from the bobbins to be brought to the end of each hollow shaft and wound about the core wire in successive layers corresponding to the number of shaft sections constituting the stranding machine.

In accordance with one presently preferred embodiment, the wire flies off the bobbins in a generally radially outward direction under the action of centrifugal forces acting on the wire. In this arrangement, tensioning means are advantageously provided for selectively limiting the extent to which the wire flies off the bobbins. In accordance with another presently preferred embodiment, the bobbins are displaced from the axis of rotation of the hollow body and the wire flies off in a generally radially inward direction, fly-off takes place under the action of external pulling forces acting on the wire.

More specifically, the present invention comprises a strander for forming cable at high speeds substantially without hazards of forming a cable with loose or drawn wire strands. The objects of the present invention are best achieved when the bobbins are mounted on a plurality of supports spaced along the axis of rotation of the shaft or body with the axes of symmetry of the bobbins substantially perpendicular to the axis of rotation of the shaft or body. The wire flies off the bobbin generally along the direction of the longitudinal axis thereof without allowing the bobbins to rotate about their individual axes. The wires drawn from the bobbins in this manner can be paid-off with practically the same wire tension throughout the entire unloading from the reel. Where it is desirable to control the tension of the wire, several types of tension control mechanisms can be adopted, and are described in the Description of the Preferred Embodiments.

The present invention also contemplates a strander which can selectively be used either in a fly-off mode wherein the bobbins are prevented from rotating about their axes or in a traditional pay off mode with rotating bobbins.

BRIEF DESCRIPTION OF THE DRAWINGS

Other objects, features and advantages of the present invention will become more apparent from a reading of the following specification, when taken in conjunction with the accompanying drawings, in which.

DESCRIPTION OF THE PREFERRED EMBODIMENTS

Figures 1, 2:
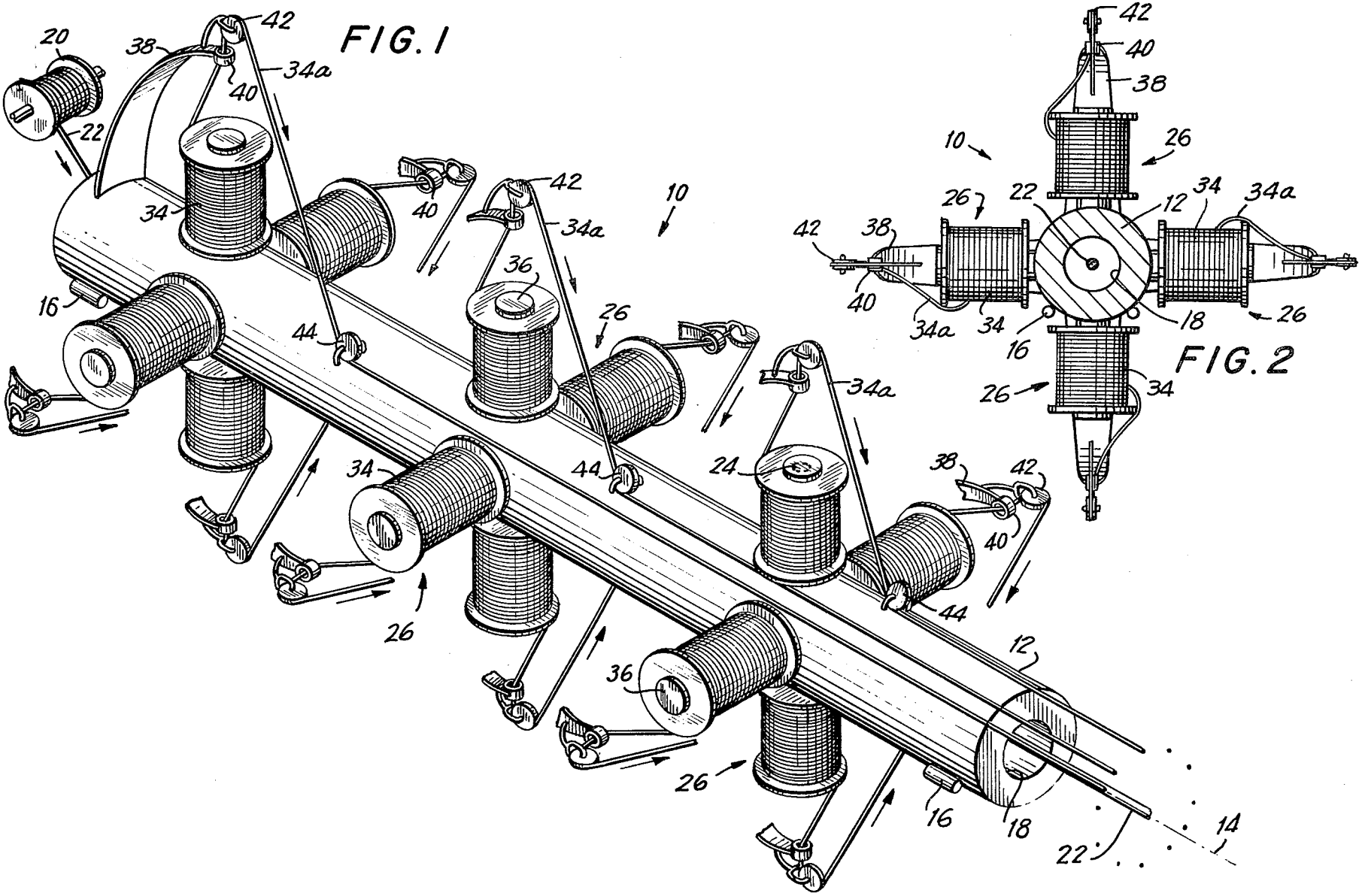
FIG. 1 is a schematic perspective view of a high-speed, rigid-type fly-off strander with the core wire passing through the machine substantially along the axis of rotation, showing a plurality of bobbin supporting shafts mounted along the length of the main shaft with their longitudinal axes substantially perpendicular to the axis of rotation of the machine.
FIG. 2 is an end elevational view of the strander showing four bobbin supports or shafts and four bobbins mounted thereon, showing the manner in which the wires fly-off the bobbins under the action of centrifugal forces and the manner in which appropriate guide means collect the wires.

Referring now specifically to the drawings, in which the identical or similar parts are designated by the same reference numerals throughout, and first referring to FIGS. 1 and 2, a rigid-type, fly-off strander in accordance with the present invention is generally designated by the reference numeral 10.

Figure 3:
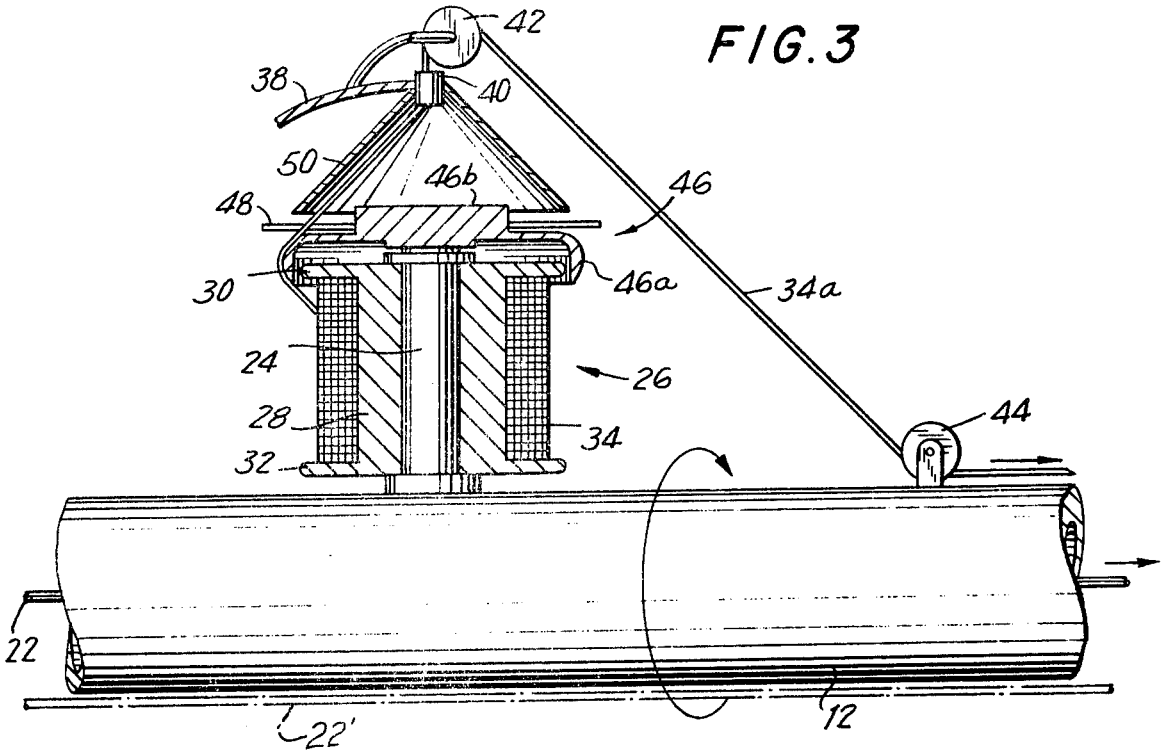
FIG. 3 is a fragmented side elevational view of the rotating body or shaft and the details, partially in cross-section, of a typical pay-off arrangement using a stationary ring and whiskers as well as an inverted funnel on the top of the bobbin to control the tension of the paid-off wire, and further showing the core wire advancing substantially along the axis of the shaft when the same is hollow and showing, in dashed outline, the path of advancement of the wire along the external surface of the shaft if the same is solid.

The strander 10 includes an elongated body or main shaft 12 mounted for rotation about its longitudinal axis 14. In the presently preferred embodiments to be described, the shaft or body is advantageously hollow for reasons to be described. However, as will also be described, the shaft or body may be solid, in which case the core advances along its external surface, as shown in FIG. 3. The shaft or frame 12 is mounted for rotation on bearings 16 in a conventional manner.

The shaft 12 is provided with an axial hole or bore 18, conventional feeding means being provided for feeding, from an outside bobbin 20, a core wire 22 substantially along the axis 14.

Suitable mounting means, shown as supporting shafts 24 in FIGS. 1 and 2, are provided for mounting bobbins 26 on the shaft in a position displaced from the axis 14 of the shaft. An important feature of the present invention is that the bobbins 26 are mounted with their longitudinal axes oriented as substantial angles from the axis 14 of the tubular frame 12. All the embodiments to be described utilize supporting shafts as the means for supporting the bobbins on the tubular frame 12. This is not a critical feature of the present invention, and any appropriate or conventional manner of mounting and maintaining the bobbins in the said position around the shaft 12 may be employed. For example, one other possible means for mounting the bobbins on the shaft 12 includes the provision of hook-type members or devices which are themselves directly or indirectly fixedly mounted on the shaft 12, and which are adapted to engage the flange of the bobbin 32 and lock the same in position on the tubular frame in order to be able to use such shaftless mounting. With the embodiment of FIGS. 1 and 2, the strength of the reel must be such as to withstand the high centrifugal forces generated during rotation. This is not the case with the embodiment shown in FIG. 5, as will be described below. Accordingly, the mounting means is not critical, although supporting shafts lend themselves very well to this application inasmuch as they result in a simple construction that facilitates placing and removing bobbins from the machine, besides providing a safe operation at high rotational speed. It is important, however, irrespective of the particular mounting means used, that the bobbins be mounted on the tubular frame 12 with the axes of symmetry thereof oriented at substantial angles from the axis 14 of the shaft, for reasons which will become apparent hereafter.

The strander shown schematically in FIGS. 1 and 2 may be referred to as a rigid-type strander since the bobbin supporting means, namely the supporting shafts 23 are rigidly fixedly mounted on the rotating tubular frame 12, and accordingly share the rotational movements therewith. Since the wire is typically paid-off the bobbins 26 without requiring the bobbins to rotate about their longitudinal axes, the strander 10 may also be denominated a fly-off strander.

As will be readily evident, rotation of the tubular frame 12 about the axis 14 will result in centrifugal forces acting on the bobbin 26 which will tend to cause such bobbins to move radially outwardly. To prevent the bobbins 26 from being ejected from the mounting shafts, it is important to provide suitable locking means 36 which positively lock the bobbins 26 on their respective supporting shafts and assures that separation therebetween will not occur. Any appropriate or conventional locking mechanisms may be utilized for this purpose. Fail-safe bobbin engaging means, such as the type shown and described in my co-pending U.S. Patent Application Ser. No. 774,587 filed on 3/7/77, now U.S. Pat. No. 4,079,580, for FAILSAFE LOCKING DEVICE FOR REEL CARRYING SYSTEMS may also be used. This co-pending application is incorporated by reference herein, the fail-safe locking device shown and described in this application being particularly simple and convenient to use in the strander 10 while providing ample safety margins during operation. To minimize the escape factor, it is advantageous that the bobbins 26 be mounted as close to the axis 14 as is physically and structurally possible. By bringing the bobbins 26 close to the axis 14, the centrifugal forces acting on the bobbins 26 are lowered, the stresses acting on the supporting shafts 24 and on the locking devices 36 are thereby reduced. By selecting a generally symmetrical configuration of bobbins or bobbin arrangements, it has been found that the bobbins 26 can be positioned sufficiently close to the axis 14 to permit the strander 10 to operate at high rotational speeds. With optimum design, the strander 10 can undoubtedly be designed to operate at substantially higher speeds. As a practical matter, however, the speed of rotation must also be selected as a function of the construction of the strand and, therefore, is also related to the linear take-up speed of the core wire 22.

Suitable guide means are provided with respect to all of the embodiments of the present invention for flying-off the wire from the bobbins 26 in a direction generally parallel to the longitudinal axes of symmetry thereof, without requiring the bobbins to rotate, and guiding the wire first around one end of the bobbin fly-off position then to a point on an axis parallel to the longitudinal axes and as close as possible to it; from this point in a direction generally along the shaft 12. In this manner, the wire 34 is paid-off the bobbins 26 and advanced to one end or take-up end of the shaft 12 and there, applied to the core wire 22 in a conventional way.

In the arrangement shown in FIGS. 2–4 and 6–8, the wire payout or guiding means are generally adapted to fly-off the wire 34 in a generally radially outward direction under the action of centrifugal forces acting on the wire. With respect to all of these embodiments, there is advantageously provided tensioning means, to be more fully described hereafter, for selectively limiting the extent to which the wire 34 flies off the bobbins 26. Turning specifically to FIGS. 1 and 2, the wire guide arrangement is shown to include an overhead or overhanging support 38 rigidly or fixedly mounted on the shaft 12 having a free end portion thereof substantially aligned with the longitudinal axis of the bobbin 26, at which end there is provided a wire collecting member, such as an eyelet 40 through which the flown-off wire **34*a* passes. The eyelet 40 aligns the just flown-off wire 34*a*, with a pulley wheel or sheave 42 over which the wire 34*a* passes and is thereby redirected from a radially outward movement to a generally radially inward movement as indicated by the arrows. An overhead support 38, which is generally positioned upstream of the bobbin with which it is associated, cooperates with a further pulley wheel or sheave 44 which is generally positioned downstream of the bobbin 26. The pulley wheel 44 is mounted on the shaft 12 and serves the function of redirecting the wire 34*a* from a generally radially inward movement to a movement generally along the axis or parallel to the axes of rotation 14. The overhead support 38, the eyelet 40, the pulley wheel 42 and the pulley wheel 44 forming the guide means in the embodiment shown in FIGS. 1 and 2 is merely illustrative and not limiting of the types of guide means which can be used to achieve the same or similar functions. It will be appreciated that various known mechanical variations may be employed in order to facilitate the loading and unloading of bobbins. For example, in the embodiments of FIGS. 1–4, 7 and 8, the overhead support 38 may be pivotally mounted to the shaft for rotation away from the bobbin shafts or affixed to a collar for rotation about the shaft to a position between bobbin shafts or constructed so as to extend sufficiently beyond the end of the bobbin shaft to facilitate the passing of a bobbin between the end of the bobbin shaft and the overhead 38**.

In FIG. 1, some of the overhead supports have only been shown partially, and some of the pulley wheels entirely omitted for the sake of clarity of illustration. However, it should be evident that each bobbin 26 is provided with a similar or appropriate wire guiding arrangement for guiding the wires from a flown-off position to one generally along the tubular frame 12.

Still referring to FIGS. 1 and 2, there are shown three bobbin arrangements, with four bobbins being provided within each such arrangement. In the embodiment being described, the bobbin arrangements or groups are spaced from each other along the axis of the shaft 12. Within each group or arrangement, the bobbins are angularly spaced from each other about the axis 14 and disposed in a generally common plane which is substantially normal to the axis 14. In order to provide a generally symmetrical arrangement which is well balanced for high speed rotations, the bobbins are advantageously uniformly spaced from each other about the axis 14 and, in the embodiment shown, the four bobbins are spaced from each other by approximately 90° to define an "X" formation as shown. The number of arrangements or groups, the number of bobbins within each such group and the angular spacing therebetween within each group is a matter of design choice and will be a function of the type of cable to be produced and, more specifically, how many strands or wires the strander 10 is to apply to the core wire 22. As suggested, it is advantageous to balance the bobbins, such as by placing them on opposite diammetrical ends of the tubular frame 12 as shown in FIGS. 1 and 2 so that centrifugal forces acting upon the bobbins effectively cancel each other out. Such an arrangement, as well as other symmetrical arrangements provide positional stability of the shaft 12 along its axis of rotation 14 during high speed rotation.

As suggested above, with respect to those embodiments of the present invention wherein the wire is flown-off in a generally outward direction under the action of centrifugal forces acting on the wire, the wire which flies-off must be maintained under appropriate tension control. As should be evident, external forces pulling on the wires at the take-up end of the shaft 12 manifest themselves in radially outward forces at the eyelet 40 and pulley wheel 42. Accordingly, external forces act in the same general direction as the centrifugal forces which act upon the wire as it flies off the bobbins. These forces are cumulative and, unless appropriate wire tensioning means are provided which introduce counteracting forces on the wire, the wires in the arrangement shown in FIGS. 1 and 2 may uncontrollably fly off the bobbins even at low rotational velocities. For this reason, in all the embodiments described, there is provided some form of tensioning means for applying a retarding force or tension on the wire just as it leaves and moves around the flange of the bobbin. Numerous wire tensioning means may be utilized for this purpose and the specific method used is not critical. The description that follows describes some forms of wire tensioning means, these being merely illustrative and not intended to be limiting of the many types of devices and arrangements which may be used for tensioning the bobbin wires.

Referring to FIG. 3, there is shown one form of presently preferred wire tension control means to prevent excessive and uncontrollable fly-off of the wire. Here, the wire guide means includes a member generally designated by the reference numeral 46, which includes a stationary ring **46*a* which is provided with a polished smooth outer surface. The number 46 also includes central hub member 46*b* which may be adapted to be fixedly engaged to the supporting shaft 24 to thereby lock the stationary ring 46*a* and the bobbin 26 on the supporting shaft 24**.

During rotation of the shaft 12, the free end of the wound wire 34 has a tendency, under the action of centrifugal forces acting thereon, to move radially outward and, in the process, move circularly around the stationary ring **46*a*. Such circular movement defines a predetermined path, namely the circular path extending about the stationary ring 46*a*. One wire tensioning means which has been found effective includes a plurality of resiliently deflectable members, such as whiskers 48, which are interposed in the predetermined path of the oscillating wire. Whiskers 48 extend from the hub 46*b* in a well known manner and resemble spokes which extend radially from the axis of the supporting shaft 24. Whiskers 48, which may be made from any suitable material such as nylon or any other resilient and flexible material, deflect upon being engaged by the wire when the tension of the wire becomes sufficiently great to deflect the whiskers 48. Accordingly, the wire is prevented from uncontrollable unwinding around the stationary ring 46*a***, this preventing a proper operation of the machine.

The whiskers 48 are only effective up to a certain speed of rotation and, if higher speeds are desired, further tensioning means are provided, in the nature of an inverted funnel 50 coaxially arranged with the longitudinal axis of the bobbin 26, the flown-off wire **34*a* being received through the large diameter end of the funnel and being removed through the small diameter end thereof as shown in FIG. 3. It will be evident that the inverted funnel 50 prevents the portion of the wire between the stationary ring 46*a* and the eyelet 40 from looping out under the effect of centrifugal forces. Such looping out only increase the length of the wire on which centrifugal forces can act, thus further escalating the rate of unwinding and ultimate damage to the wire and impairment in the machine operation. The inverted funnel 50 is advantageously provided with an internal smooth surface which, however, nevertheless applies a frictional force upon the wire which counteracts the outward centrifugal forces. The inverted funnel 50, together with the whiskers 48**, provide retarded or tensioning forces which are effective to control fly-off.

It may also be mentioned with respect to FIG. 3, that whiskers 48 are generally considered satisfactory insofar as small gauge wires are concerned. However, whiskers are generally not suitable for heavy gauge wires since the braking forces the whiskers develop are not sufficient to counteract the higher centrifugal forces acting on the heavier wires. The embodiment shown in FIG. 3 is primarily suitable for low gauge wires although, with the provisions of the inverted funnel 59, the strander shown in FIG. 3 may also be used for heavier gauge wires.

The core wire 22, shown in solid outline, advances through the axial hole or bore 18 substantially along the axis of rotation of the shaft or body 12. With this arrangement the core wire 22 is not deflected and, therefore, is not subjected to damage during operation. Additionally, this arrangement permits the use of large core wires. However, if a solid shaft or body is used, the present invention can still be practiced by advancing the core wire 22', shown in FIG. 3 in dashed outline, along the external surface of the shaft or body.

Figure 4:
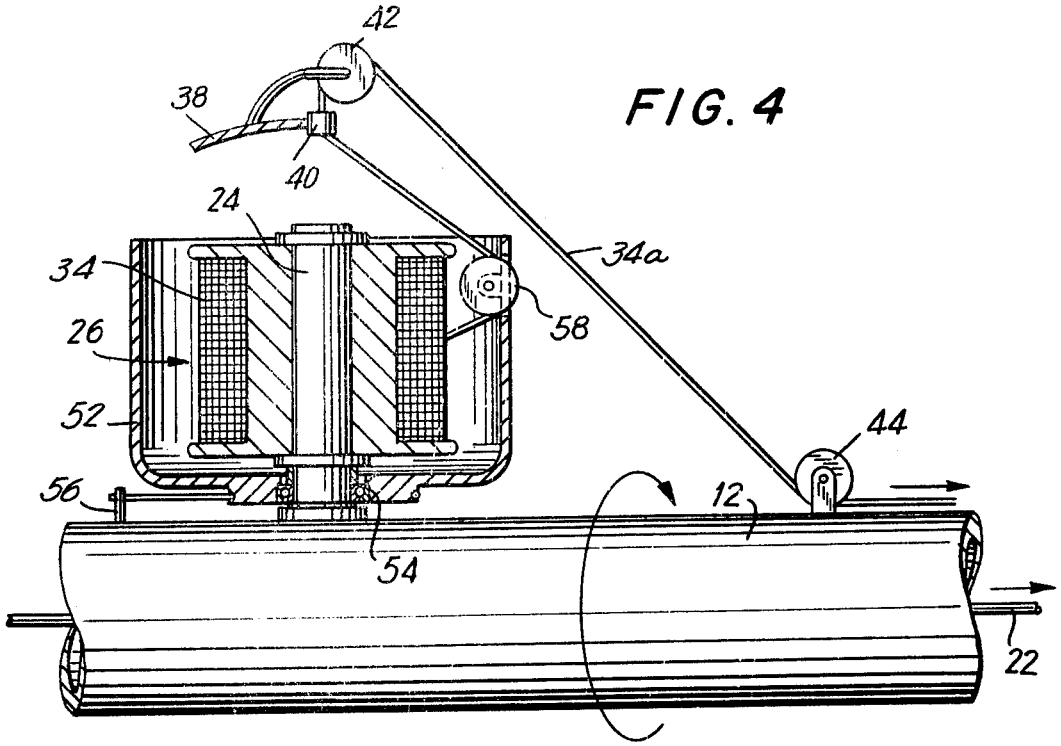
FIG. 4 is a similar view to FIG. 3, but showing an alternate arrangement that can be used to control the tension on the unwinding wire, the wire being guided through a pulley attached to an inverted bell or cup mounted on bearings.

Referring to FIG. 4, there is shown a further embodiment of the present invention which provides a means for positively controlling tension. As suggested above, the fly-off mode occurs in any system where the wire is paid-off from a stationary bobbin, i.e., a bobbin which does not rotate about its own axis. While the embodiment shown in FIG. 4 may also be utilized for relatively low gauge wires, it is particularly suitable for heavier gauge wires which would normally be exposed to very high centrifugal forces and would, therefore, have the tendency to uncontrollably fly off the bobbin. In FIG. 4, there is provided a cylindrical frame or shell, shown as a rotating bell or cup 52 open at the axial end facing away from the axis of rotation 14 of the tubular frame 12, and mounted at the opposite axial end on the supporting shaft 24 by means of a suitable bearing 54. An important feature of this rotating shell 52 is that it is as symmetrically balanced as possible so that it does not show preferential positional patterns when rotating around its own axis in the centrifugal force field created by the rotation of the main shaft 12 around the axis 14.

The rotating bell or cup 52 may be permitted to freely rotate on the bearing 54 about the axis of the supporting shaft 24 or rotational movements may be dampened by means of a suitable and conventional adjustable braking means which is shown in FIG. 4 as a ribbon or band type brake mechanism 56.

In operation, the wire paid-off from the bobbin 26 is looped about the pulley wheel 58 prior to entering the eyelet 40. When the adjustable brake mechanism totally removes the braking forces on the rotating bell or cup 52, it rotates about the axis of the supporting shaft 24. The wire **34*a* is paid-off the bobbin 26 when external pulling forces are applied to the wire. There is always friction in the bearings 54 and since the rotating bell or cup 52 has a predetermined amount of inertia, there will always be applied a tension to the paid-off wire between the bobbin and the pulley wheel 58. Such tension is sufficient to prevent looping of the wire between the pulley wheel 58 and the eyelet 40 and, therefore, uncontrollable fly-off is prevented. With heavier gauge wires, where bearing friction and the inertia of the bell or cup 52 is not sufficient to provide suitable tensioning forces, the adjustable brake 56 may be used to increase the tension on the wire. To prevent hang-up or locking of the rotating bell or cup 52, as suggested above, the bell or cup 52** should be evenly balanced about its own axis of rotation.

Figure 5:
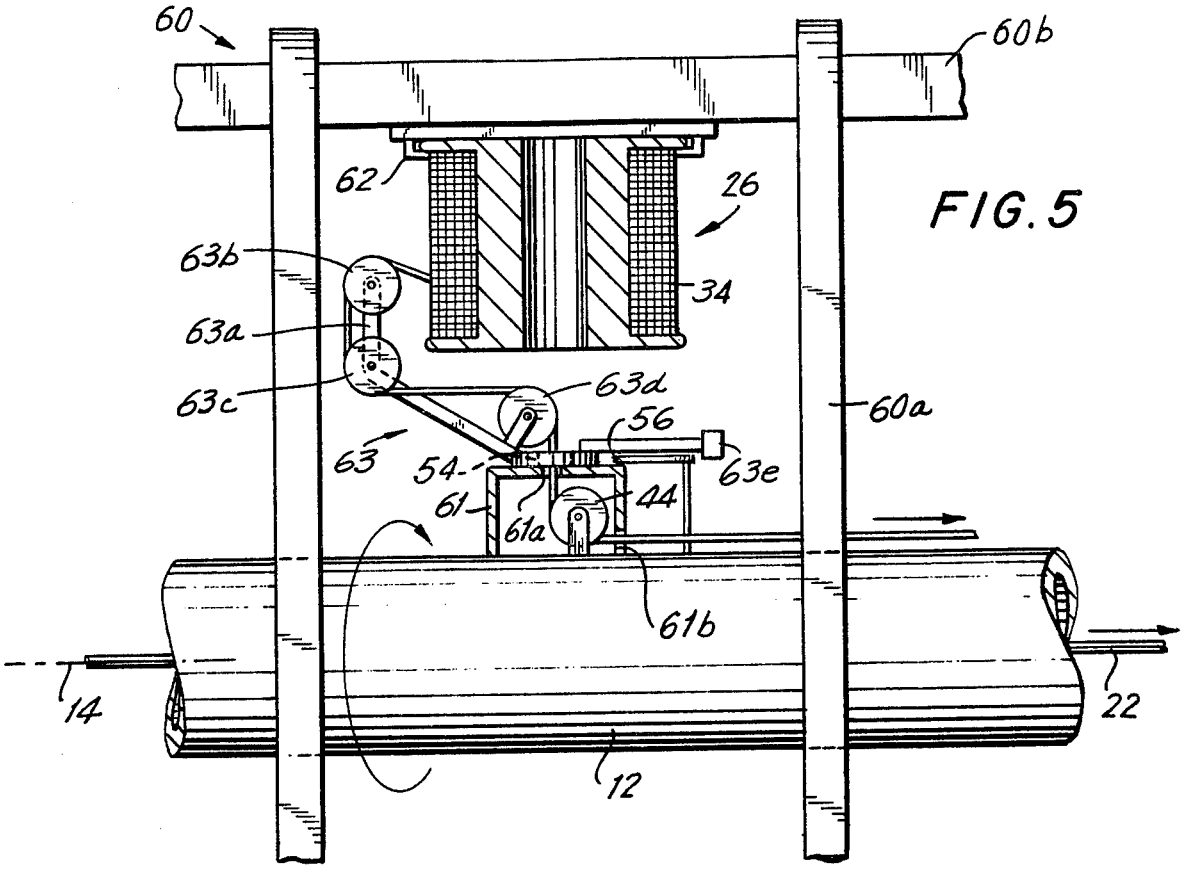
FIG. 5 is a view generally similar to FIGS. 3 and 4 but showing an arrangement wherein the wire is paid-off from the periphery towards the center of the machine.

As suggested above, the present invention also contemplates positioning the bobbins on the shaft in a position displaced from the axis of rotation of the shaft 12 in such a manner so that fly-off of the wire is in a generally radially inward direction. In this case, fly-off takes place under the action of external pulling forces acting on the wire. Referring to FIG. 5, there is shown a frame member generally designated by the reference numeral 60 which is mounted on the shaft 12 for rotation therewith about the axis 14. The frame member includes, by way of illustration only, a pair of end plates or members **60*a* and a generally transverse or cross member 60*b* which is generally parallel to the axis of rotation as shown. The cross member 60*b* comprises a support portion which is radially spaced from the body or shaft 12. Here, hook-type members or devices 62 are fixedly mounted on the support portion 60*b* to position the bobbin between the shaft 12** and the support cross member.

The embodiment shown in FIG. 5 operates in a manner generally similar to that described in connection with FIG. 5. Whereas a rotating cylindrical frame or shell 52 is used in conjunction with a stationary bobbin, the embodiment shown in FIG. 5 utilizes a rotating guide and tensioning system 63 which is mounted on a bearing 54, which is itself fixedly mounted on the shaft 12 through the supporting housing or structure 61.

The rotating guide and tensioning system 63 generally comprises an elongate arm **63*a*, along the length of which there are provided two or more guiding sheaves or pulleys 63*b*–63*d*. The free end of the arm 63*a*** extends to a generally intermediate position along the longitudinal length of the bobbin.

The rotating guide and tensioning system must be balanced as symmetrically as possible by use, for example, by use of counterweights **63*e* (only shown in FIG. 5), or any other suitable compensating method, so that it does not show preferential positional patterns when rotating around its own axis in the centrifugal force field created by the rotation of the main shaft 12 around the axis 14**.

As with the embodiment shown in FIG. 4, a brake 56 may also be used to dampen the rotational movements of the rotating tensioning and guide system 63.

In operation, the embodiment shown in FIG. 5 causes the wire **34*a* to fly-off or be paid-off in a generally radially inward direction under the action of external forces acting on the wire, as indicated by the arrow. Under the action of the external pulling forces acting on the wire 34*a*, the rotating guide and tensioning system begins to rotate, thus allowing the wire 34 to become unwound from the stationary bobbin 26 under a constant tension controlled by the brake 56. During such unwinding, the wire 34*a* is guided along the arc 63*a* by means of the pulleys 63*b*–63*d* and caused to enter the support structure or housing 61 through the hole or eyelet 61*a*. Inside the support structure or housing 61, there is provided a pulley 44 which redirects the wire 34*a* in a direction parallel to the axis of rotation of the shaft 12, and the wire 34*a* subsequently leaves the housing 61 through a hole or eyelet 61*b*** as shown.

While the arrangement shown in FIG. 5 is the presently preferred one, other arrangements may also be possible which mount the bobbins on a support or frame member 60. The specific guide and tensioning devices or arrangements are not critical and any conventional means for guiding and tensioning a wire which is unwound from a bobbin mounted as shown may be used.

Figure 6:
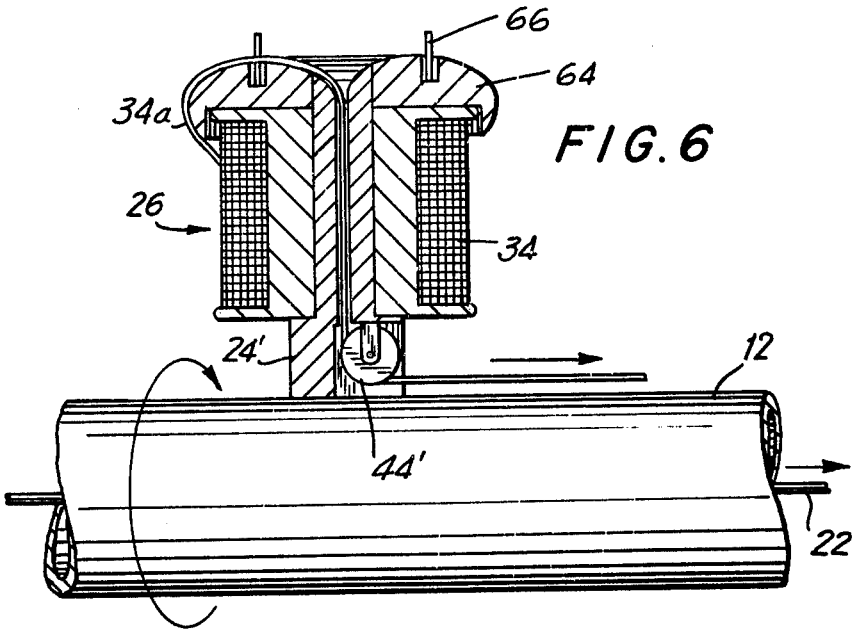
FIG. 6 is generally similar to FIGS. 3–5, but showing an annular polished ring cooperating with a hollow supporting shaft which permits a minimal length of the wire to be exposed to centrifugal forces inasmuch as the wire is immediately, upon flying-off, drawn interiorly of the supporting shaft by means of an externally applied pulling force.

Referring to FIG. 6, there is shown a further embodiment of the present invention wherein the supporting shaft 24' is provided with a longitudinal bore therethrough, the supporting shaft 24' being fixedly mounted on the body or tubular frame 12 in the above-described embodiments. The supporting shaft 24' has an opening in the lower region thereof where it is connected to the hollow shaft, which opening is in communication with the central bore. An annular polished ring 64 operates with the supporting shaft 24' to cover the outer rim of the bobbin 26. In this embodiment, the wire which is paid-off the bobbin is drawn through the bore and lower opening to bring the wire to a position along the tubular frame while exposing only a relatively small length of the wire to centrifugal forces. Specifically, the length of wire exposed to centrifugal forces is that length which extends about the polished surface of the annular ring 64. Minimizing the length of the loop of wire which is exposed to centrifugal forces, fly-off may be controlled simply by the application of suitable externally applied pulling forces, as indicated by the arrow in FIG. 6. At higher rotational velocities of the strander, it may be advantageous to provide auxiliary wire tensioning means, such as the whiskers 66. While the whiskers have been shown to be oriented in directions parallel to the axis of the supporting shaft 24', the whiskers may be disposed at any other angle, as suggested by the dashed outlines, so long as the whiskers are positioned in a predetermined path which the paid-off wire traverses when it leaves the bobbin.

Figure 7:
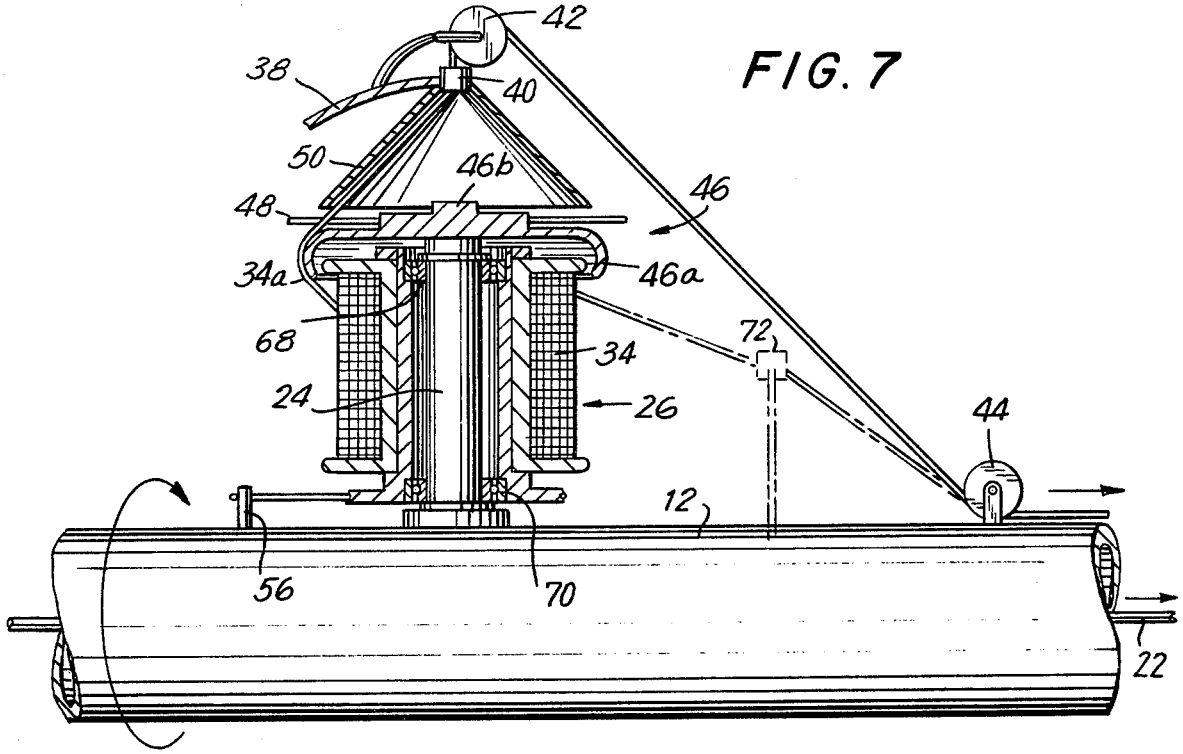
FIG. 7 is generally similar to FIGS. 3–6, but showing an arrangement which makes it possible to pull the wire off the bobbin in a traditional manner by allowing the reel to rotate, or flying it off the bobbin while stationary, this rotation arrangement being made possible by the provision of an adjustable brake mechanism and an auxiliary guide means for paying-off the wire on the bobbin during rotation thereof.

In FIG. 7, a bobbin support arrangement and wire tensioning control means is shown which is very similar to the embodiment shown in FIG. 3. However, here means are provided for rotatably mounting the bobbin 25 on its supporting shaft. To do this, there is provided, for example, in addition to the inner stationary shaft 24*a*, an outer shaft 24*b* which is mounted for rotation about the inner shaft 24*a* by means of bearings 68, 70. An adjustable brake mechanism 56 similar to the one described in connection with FIG. 4, is provided for controlling the braking forces which are applied to the outer shaft 24*b*.

This construction provides a double utilization machine when an auxiliary guide means in the nature of an optional eyelet 72 is provided as shown in FIG. 7, brake mechanism is adjusted to release the outer shaft 24*b* to permit the same to rotate about its axis. The machine may be operated as a standard, rigid-type strander wherein the wire is directly paid-off from the bobbin which rotates about its axis. The machine may be utilized as a fly-off strander as described in connection with FIG. 3, while the eyelet 72 is not utilized, but the wire is guided radially outwardly as shown in FIGS. 3 and 7 and described above. In the fly-off mode, the adjustable braking mechanism 56 is adjusted to apply a braking force to the outer shaft 24*b* so that the bobbin does not rotate about its axis. Thus, the embodiment shown in FIG. 7 can be utilized to directly pay-off the wire off a rotating bobbin or fly-off the wire from a stationary bobbin.

Figure 8:
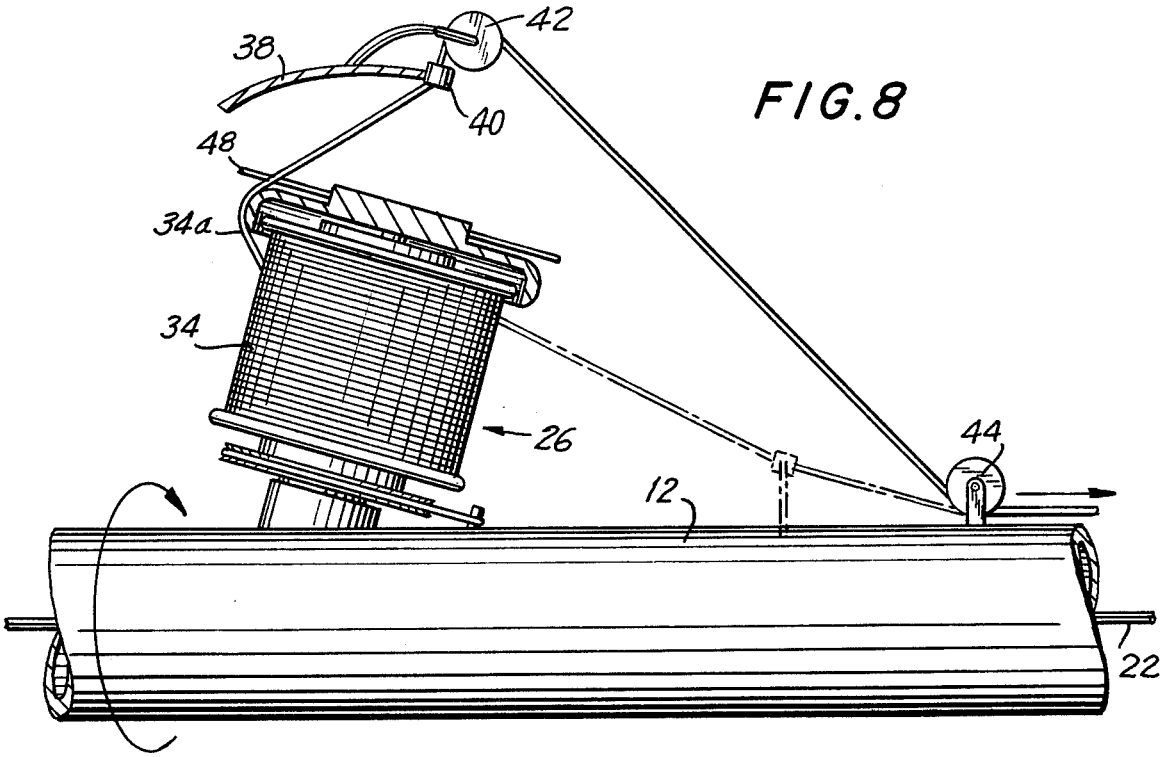
FIG. 8 is generally similar to FIG. 7, except that the bobbin supporting shaft has an axis which is inclined with respect to the normal direction to the axis of rotation of the bobbin.

The same arrangement shown in FIG. 7 is shown in FIG. 8, except that the axis of symmetry of the bobbin as well as the supporting shaft is generally inclined at an angle $\alpha$ from a reference line parallel to the axis of rotation 14 of the tubular frame 12. As described above, one of the important features of the present invention is that the axis of symmetry of the bobbin is oriented at a substantial angle $\alpha$ from the axis 14 of the tubular frame 12. The angle $\alpha$ has been shown in all of the embodiments as being substantially equal to 90°. This has been done so that in the fly-off mode, centrifugal forces will be substantially constant on the wire that unwinds about the rim of the bobbin. It will be evident that inclination of the axis of symmetry places one portion of the bobbin rim closer to the axis than the diammetrically opposite portion of the rim, thus resulting in tension oscillations on the wire. The invention is operative also at angles $\alpha$ less than 90°, the limiting angle being a function of numerous factors, including the gauge of the wire, the maximum speed of rotation of the strander and the diameter of the bobbin rims. The presently preferred angle $\alpha$ for all of the aforementioned embodiments which operate in the fly-off mode is approximately 90°, although nominal variations from the substantially normal orientation with respect to the axis of rotation 14 should not materially adversely affect the operation of the strander.

Various tensioning and pay-off means have been described which can be used with the strander of the present invention. In some cases such tensioning or pay-off means has been described in connection with only one particular support arrangement of a bobbin. Moreover, it will be evident to those skilled in the art that features described can be modified and, in most instances, interchangeably used on the variously described embodiments. For example, it is possible, with minor modifications, to utilize tensioning means, such as the rotating bell or cup 52 of FIG. 4 in the embodiment shown in FIG. 5. Similarly, it will be evident that the bobbin of FIG. 5 may be rotatably mounted as in FIG. 7, and the wire payed off in the conventional manner with the bobbin rotating by provision of suitable guides, such as pulleys mounted on the frame member 60.

While this invention has been described in detail with particular reference to presently preferred embodiments thereof, it will be understood that variations and modifications can be effected within the spirit and scope of the invention.

What is claimed is:

1. A strander comprising at least one elongated main shaft mounted for rotation about its own axis and adapted to advance a core wire proximate to the axis of rotation of the strander; support means for securing a plurality of wire carrying bobbins externally of said main shaft in positions displaced from the axis of rotation of said main shaft and with the longitudinal axes of said bobbins oriented at a substantial angle from the axis of rotation of said main shaft; and wire payout means for guiding wire over and around one end of a respective bobbin, thence about a point on an axis substantially coincident with the longitudinal axis of a respective bobbin, without requiring the bobbins to rotate about their individual axes, and thence in a direction generally parallel to the axis of rotation of the strander thus enabling the wires which are paid off from the bobbins to be brought to the end of each main shaft and wound about the core wire in successive layers corresponding to the number of shaft sections constituting the stranding machine.

2. A strander as defined in claim 1, wherein said wire payout means is adapted to fly off the wire in a generally radially outward direction over and around one end of a respective bobbin under the action of centrifugal forces acting on the wire; and further comprising tensioning means for selectively limiting the extent to which the wire flies off the bobbin.

3. A strander as defined in claim 2, wherein said main shaft is hollow and adapted to advance the core wire substantially along the axis of rotation of said elongated shaft.

4. A strander as defined in claim 2, wherein said main shaft is solid and adapted to advance the core wire along the external surface of said elongated shaft.

5. A strander as defined in claim 2, wherein said wire payout means includes pulley means mounted on said main shaft.

6. A strander as defined in claim 5, wherein said pulley means includes a first pulley wheel radially spaced from the bobbin and substantially aligned with the longitudinal axis of the bobbin, and a second pulley wheel mounted on said main shaft in proximity of the exterior surface thereof, the wire case off radially outwardly during fly-off being redirected radially inwardly by said first pulley wheel, and subsequently redirected in a direction parallel to said axis of said main shaft by said second pulley wheel.

7. A strander as defined in claim 5, wherein said wire payout means further comprises an alignment member to align the cast off wire with said first pulley wheel.

8. A strander as defined in claim 7, wherein said alignment member comprises an eyelet.

9. A strander as defined in claim 1, wherein said support means includes locking means for locking the bobbin on said shaft against radial movements with respect thereto.

10. A strander as defined in claim 1, wherein said support means comprises a plurality of support members on said shaft.

11. A strander as defined in claim 10, wherein said support members comprise supporting shafts fixedly mounted on said main shaft, said supporting shafts being oriented in directions substantially normal to said axis of said main shaft and dimensioned to be receivable within the bores of bobbins or reels mounted therein.

12. A strander as defined in claim 10, wherein said support members are arranged in groups respectively spaced from each other along said axis of said main shaft.

13. A strander as defined in claim 12, wherein each group includes a plurality of support members angularly spaced from each other about said axis of said main shaft and disposed in a common plane substantially normal to said axis of said main shaft.

14. A strander as defined in claim 13, wherein said support members are uniformly spaced from each other about said axis.

15. A strander as defined in claim 2, wherein the wire that flies off the bobbin traverses a predetermined path, said tensioning means comprising a plurality of resiliently deflectable members interposed in said predetermined path, whereby engagement and deflection of said resilient members by the wire establishes a tension in the wire and braking action thereon.

16. A strander as defined in claim 15, wherein said plurality of resiliently deflectable members comprises whiskers radially oriented and angularly spaced about the longitudinal axis of the bobbin.

17. A strander as defined in claim 2, wherein said tensioning means comprises an inverted funnel coaxially arranged with the axis of symmetry of the bobbin, the case off wire being received through the larger diameter end of said funnel and being removed through the smaller diameter end thereof.

18. A strander as defined in claim 1, wherein said payout means includes a substantially smooth ring covering at least a portion of the end of the bobbin off which the wire flies off, whereby the wire can be cast off the bobbin by engaging the smooth ring in place of a portion of the bobbin to thereby minimize frictional forces on the wire and the possibility of damage thereto.

19. A strander as defined in claim 1, wherein said tensioning means comprises a substantially cylindrical frame mounted for rotation on said main shaft about an axis coaxial with the longitudinal axis of the bobbin; and a pulley wheel mounted on said cylindrical frame, the wire payed off the bobbin extending about said pulley wheel prior to flying off the bobbin, whereby flying wire off the bobbin causes said cylindrical frame to rotate about the axis thereof and apply a braking tension on the wire.

20. A strander as defined in claim 19, wherein said cylindrical frame comprises a cup or bell-shaped wall.

21. A strander as defined in claim 19, wherein said cylindrical frame is mounted on said main shaft by means of a bearing.

22. A strander as defined in claim 19, further comprising adjustable braking means for applying a controllable braking force acting on said cylindrical frame, whereby the tension and the rate at which the wire is flown off the bobbin can be adjustably controlled.

23. A strander as defined in claim 22, wherein said adjustable braking means comprises a ribbon or band-type mechanism cooperating with said cylindrical frame.

24. A strander as defined in claim 1, further comprising a frame member mounted on said main shaft for rotation therewith, said member having at least one support portion radially spaced from said main shaft, said mounting means being adapted to mount a bobbin on said at least one support portion to position the bobbin between said main shaft and said at least one support portion, said wire payout means being adapted to fly-off the wire in a generally radially inwardly direction, fly-off taking place under the action of external pulling forces acting on the wire.

25. A strander as defined in claim 24, wherein said wire payout means is provided with a smooth surface about the bobbin at the radially innermost flange of the bobbin where the wire is paid off to prevent damage to the wire.

26. A strander as defined in claim 24, further comprising tensioning and guide means in the nature of a device mounted for rotation on said main shaft about an axis substantial coaxial with the longitudinal axis of the bobbin, whereby flying wire off the bobbin causes said device to rotate about the axis thereof.

27. A strander as defined in claim 26, wherein said device comprises a generally elongate arm having at least a portion thereof extending to a position generally intermediate the spaced flanges of the stationary bobbin, and further comprising a plurality of pulley wheels spaced from each other along said elongate arm to guide the wire from the fly-off position to a position generally parallel to the axis of said main shaft.

28. A strander as defined in claim 26, wherein said device is mounted on said main shaft by means of a bearing.

29. A strander as defined in claim 24, wherein said main shaft is hollow and adapted to advance the core wire substantially along the axis of rotation of said elongated shafts.

30. A strander as defined in claim 24, wherein said main shaft is solid and adapted to advance the core wire along the external surface of said elongated shaft.

31. A strander as defined in claim 19, further comprising adjustable braking means for applying a controllable braking force acting on said device, whereby the tension and the rate at which the wire is flown off the bobbin can be adjustably controlled.

32. A strander as defined in claim 2, wherein said support means comprises a supporting shaft provided with a longitudinal bore therethrough, said supporting shaft being fixedly mounted on said main shaft with the axis of said supporting shaft being oriented at a substantial angle from said axis of said main shaft, said supporting shaft having an opening in the portion thereof connected to said main shaft which opening is in communication with said bore, whereby a wire may be paid off a bobbin mounted on said supporting shaft and drawn through said bore and opening to bring the wire to a position along said main shaft while exposing only a relatively small length of the wire to centrifugal forces.

33. A strander as defined in claim 32, wherein said wire payout means includes a polished annular ring adapted to cover the radially outermost portions of the bobbin, said polished annular ring permitting the wire paid off the bobbin to enter said bore by sliding over said polished annular ring.

34. A strander as defined in claim 33, wherein the wire paid off the bobbin traverses a predetermined path as it is cast off the bobbin and drawn into said bore, and wherein said tensioning means includes a plurality of resiliently deflectable members interposed in said predetermined path, engagement and deflection of said resilient members by the wire establishing a tension in the wire and a braking action thereon.

35. A strander as defined in claim 34, wherein said resiliently deflectable members are spaced on said polished annular ring and are oriented at angles substantially parallel to the longitudinal axis of the bobbin.

36. A strander comprising at lease one elongated main shaft mounted for rotation about its own axis and adapted to advance a core wire proximate to the axis of rotation of the strander; support means for securing a plurality of wire carrying bobbins externally of said main shaft in positions displaced from the axis of rotation of said main shaft and with the longitudinal axes of said bobbins oriented at a substantial angle from the axis of rotation of said main shaft; and wire payout means for guiding wire over and around one end of a respective bobbin, thence about a point on an axis substantially coincident with the longitudinal axis of a respective bobbin, and thence in a direction generally parallel to the axis of rotation of the strander thus enabling the wires which are paid off from the bobbins to be brought to the end of each main shaft and wound about the core wire in successive layers corresponding to the number of shaft sections constituting the stranding machine.

37. A strander as defined in claim 36, wherein said support means comprises a supporting shaft fixedly mounted on said main shaft with the axis of said supporting shaft being oriented at a substantial angle from said axis of said hollow shaft; further comprising means for rotatably mounting a bobbin on said supporting shaft, and adjustable braking means for controllably adjusting the braking forces effective to limit the freedom of the bobbin to rotate on said supporting shaft.

38. A strander as defined in claim 37, further comprising auxiliary wire payout means mounted on said main shaft for guiding the wire on the bobbin directly therefrom to thereby pay off the wire off the bobbin as the same rotates about said supporting shaft, whereby the wire can be paid off the bobbin by flying the wire off when said adjustable braking means applies a substantial braking force to the bobbin and by paying the wire off directly by means of said auxiliary guide means when said adjustable braking means substantially removes braking forces to the bobbin.

* * * * *